United States Patent [19]

Lautenschläger

[11] 4,251,900

[45] Feb. 24, 1981

[54] OVER-CENTER CROSSLINK HINGE

[75] Inventor: Reinhard Lautenschläger, Reinheim, Fed. Rep. of Germany

[73] Assignee: Karl Lautenschlager KG, Mobelbeschlagfabrik, Reinheim, Fed. Rep. of Germany

[21] Appl. No.: 959,734

[22] Filed: Nov. 13, 1978

[30] Foreign Application Priority Data

Dec. 17, 1977 [DE] Fed. Rep. of Germany ..... 2756319

[51] Int. Cl.[3] ..... E05D 11/10

[52] U.S. Cl. ..... 16/145; 16/163; 16/50

[58] Field of Search ..... 16/163, 164, 182, 142, 16/145, 146, 180, 50

[56] References Cited

U.S. PATENT DOCUMENTS

| | | | |
|---|---|---|---|
| 2,623,236 | 12/1952 | Borchers et al. | 16/182 X |
| 3,363,281 | 1/1968 | Borsani | 16/163 |
| 4,075,735 | 2/1978 | Rock et al. | 16/163 X |
| 4,117,569 | 10/1978 | Lautenschlager et al. | 16/145 X |
| 4,123,823 | 11/1978 | Lautenschlager et al. | 16/145 |

FOREIGN PATENT DOCUMENTS

| | | | |
|---|---|---|---|
| 7510753 | 9/1975 | Fed. Rep. of Germany . | |
| 2552729 | 6/1977 | Fed. Rep. of Germany | 16/163 |
| 1532667 | 6/1968 | France | 16/163 |

*Primary Examiner*—Andrew V. Kundrat

[57] ABSTRACT

A crosslink over-center hinge having a supporting wall member and a door member which are joined together by a crosslink mechanism formed by two linkage arms coupled pivotingly together in their middle area, the end of one linkage arm being directly journaled on the supporting wall member and one end of the other being directly journaled on the door member, the other end in each case being coupled to the other hinge member for guidance on a curve in space. The hinge having an over-center mechanism is provided with a closing spring, which mechanism resiliently urges the hinge to the hinge end position at least in the vicinity of the closed position. A link connecting the door member to one linkage arm is so formed that its middle area is situated, when the hinge is in the closed position, in the vicinity of the pivot shaft pivotingly coupling the linkage arms, while the over-center mechanism is disposed on or in this link and has an elongated over-center element pivotingly mounted on the pivot shaft of the link in the door member with a locking surface engaging the linkage arm pivot shaft in range of the hinge-closed position. The over-center element is biased by the closing spring supported in the area of the other end of the link towards an engagement of its locking surface with the linkage arm pivot shaft.

11 Claims, 3 Drawing Figures

OVER-CENTER CROSSLINK HINGE

BACKGROUND

The invention relates to a crosslink over-center door hinge having a supporting wall member and a door member which are joined together by a crosslink mechanism formed by two linkage arms journaled together in their middle area, one end of each linkage arm being journaled directly on the supporting wall member or the door member, as the case may be, while the other end is coupled to the other member in such a manner that it is guided on a curve in space, and the coupling of the door end of the linkage arm that is journaled directly on the supporting wall member to the door member being accomplished by a link journaled on the door member at one end and on the linkage arm on the other, while the cabinet-internal end of the linkage arm directly journaled on the door member is coupled to the supporting wall member either by a frictional guidance of the linkage arm on the supporting wall member or indirectly by an interposed link, and having an over-center or snap-action mechanism provided with a closing spring, which resiliently forces the hinge to its end position at least when it is closed to the closed position.

Crosslink hinges are used in modern furniture construction whenever the desired door opening and closing movement cannot be achieved with the simpler and therefore less expensive four-joint hinges. Thus, for example, it is not possible with four-link hinges to achieve opening angles of much more than 105° and 110°, and therefore the hinges which have to open to 180° are today mostly constructed in the form of crosslink hinges. Even in the case of doors to be opened to less than 180°, the use of crosslink hinges may be necessary if the door to be mounted has to perform upon opening a relatively great component of movement out of the cabinet interior while remaining in front of the cabinet carcass. This is the case, for example, in certain recessed doors in which the thickness of the door leaf is relatively great. Crosslink hinges for 180° opening angle are known, in which an over-center mechanism is incorporated which in the vicinity of the closed position forces the hinge to the end position. This over-center mechanism is formed, in a known crosslink hinge (German Offenlegungsschrift No. 2,552,729) for example by a pusher disposed for longitudinal displacement within one link arm, the pusher being biased by a spring, in the vicinity of the closed position, against a cam formed on on the door-related hinge member. The reaction force thus produced exercises the desired thrust in the closing direction.

This over-center mechanism operates satisfactorily, but when the door is opened the relatively large cam projecting from the cabinet becomes visible, and this is considered to be to some extent unsightly. In another known cross-link over-center hinge (German Petty Patent No. 7,510,753), there is provided in one linkage arm a spring-biased rocker arm whose one end has a recess which, when the closed position is approached, engages a transverse pin in a link coupled to this linkage arm and, as the closing movement continues, is forced beyond a dead center position into a locking position. This over-center mechanism has the disadvantage that, when the hinge is open, the rocker arm can be shifted to the locking position by tampering. When an attempt is then made to close the door, the transverse pin does not enter into the recess in the rocker arm but strikes against the outside of the rocker arm. The over-center action then does not take place and the door cannot be fully closed.

THE INVENTION

The invention, however, has the object of creating a crosslink hinge with over-center mechanism which, although being of small size and absolutely reliable in operation, will be foolproof and will not be noticeable in the open position. At the same time, the over-center mechanism is to be suitable especially for those crosslink hinges in which the production of a strong component of movement out of the cabinet interior is important.

Setting out from a hinge of the kind mentioned in the beginning, this object is achieved by the invention in that the link connecting the door-related member of the hinge to the first linkage arm is made such that, when the hinge is in the closed state, its central area will lie adjacent the pivot pin coupling the linkage arms; that the over-center mechanism is disposed on or in this link, and an over-center element journaled in the door-related hinge member has a locking cam flank lying against the linkage arm pivot axis in the vicinity of the hinge-closed position, and that the over-center element is biased by a closing spring thrusting against the other end of the link towards the engagement of its locking cam flank with the linkage arm pivot pin. In this arrangement of the over-center element it is possible, as tests have shown, that the locking cam flank and hence the over-center element itself, can be kept relatively small, and an extraordinarily precise and reliable over-center function is obtained, which is attributed to leverage resulting from the kinematics of the link or link arm.

In a preferred further development of the invention, the link receiving the over-center mechanism has two separate and parallel side plates between which the over-center element and the closing spring are disposed. To prevent the over-center element from being forced by the closing spring out of the link when the hinge is in the positions in which the linkage arm pivot pin is not engaged, it is recommended that the two side plates of the link be joined together by a web serving simultaneously as a stop for limiting the swing of the over-center element.

In an advantageous embodiment of the invention, the closing spring is a coil spring under compressive bias whose end remote from the over-center mechanism thrusts against the pivot pin joining the link to the linkage arm.

This coil spring can be held simply by a pin-like element passing through its center, and having a head against which the coil spring thrusts and through which passes the pivot pin whereby the link is journaled on the linkage arm.

The side plates of the link cover, in a substantially complete manner, the over-center element, the closing spring and any parts holding them, so that the over-center mechanism of the finished hinge is virtually concealed from view.

It has been found desirable to provide the cam on the over-center element also with an ascending flank which the linkage arm pivot pin will engage and on which it will ride up before the closed position is reached in the closing movement of the hinge, so that a force operative in the hinge opening direction will at first act on the linkage arm pivot shaft, as a result of the spring bias exercised on the over-center element, until a dead-center position is reached at the crest of the cam at the junction between its flanks. As the closing movement continues, the linkage arm pivot pin rides down the locking flank of the cam, so that the force of the closing spring will be exercised in the hinge closing direction. The over-center characteristic can be adapted to meet various requirements by varying the shape of the cam cooperating with the pivot pin.

To prevent wear on the cam, the linkage arm pivot pin can bear a loose, rotatable sleeve or roller which can roll on the cam. On the other hand, such a roller can be dispensed with if the over-center element is made of a material having good antifriction properties. The over-center element and/or the parts holding the closing spring in the link are therefore made advantageously from plastic, preferably by the injection molding process.

The invention will be further explained in the following description of an embodiment in conjunction with the drawing, wherein.

Figure 1:
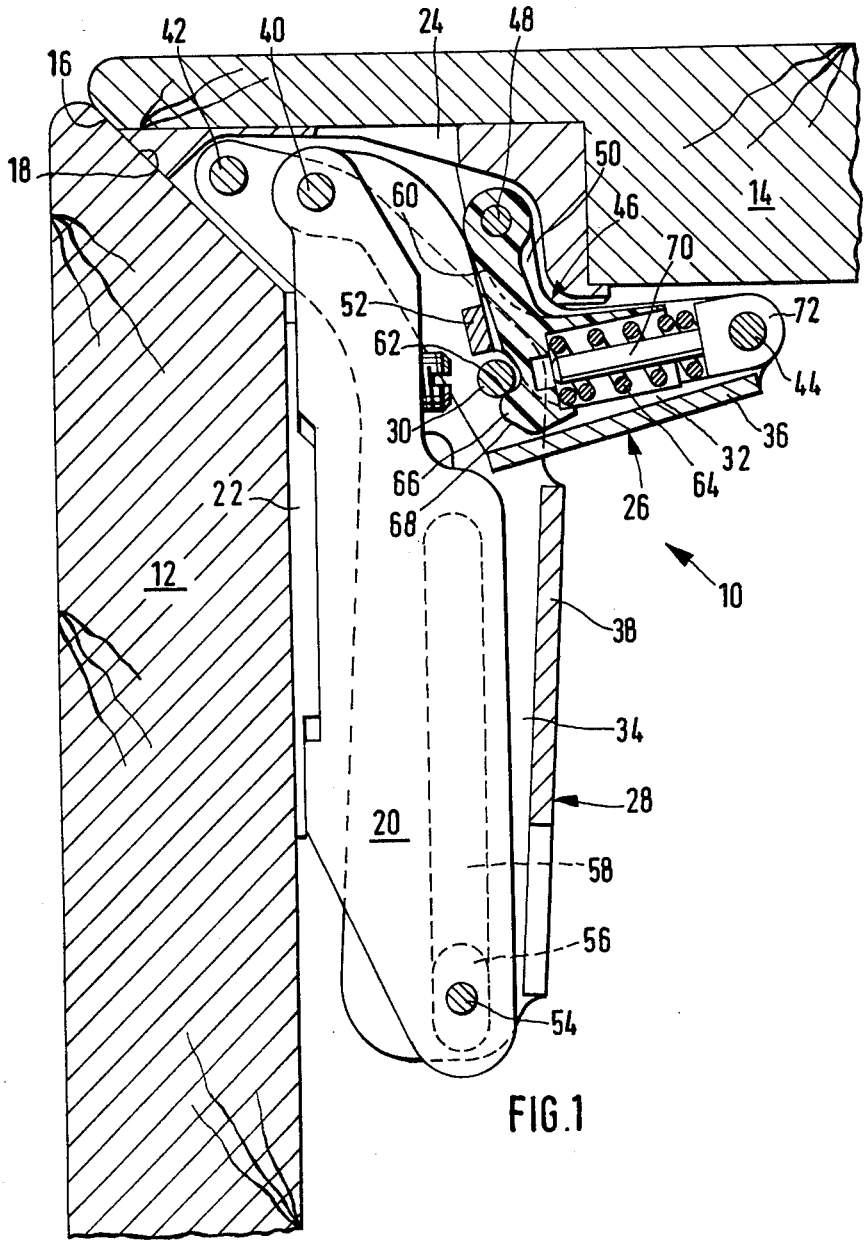
FIG. 1 is a side view, partially in section, of a crosslink over-center hinge of the invention in the closed position.
Figure 2:
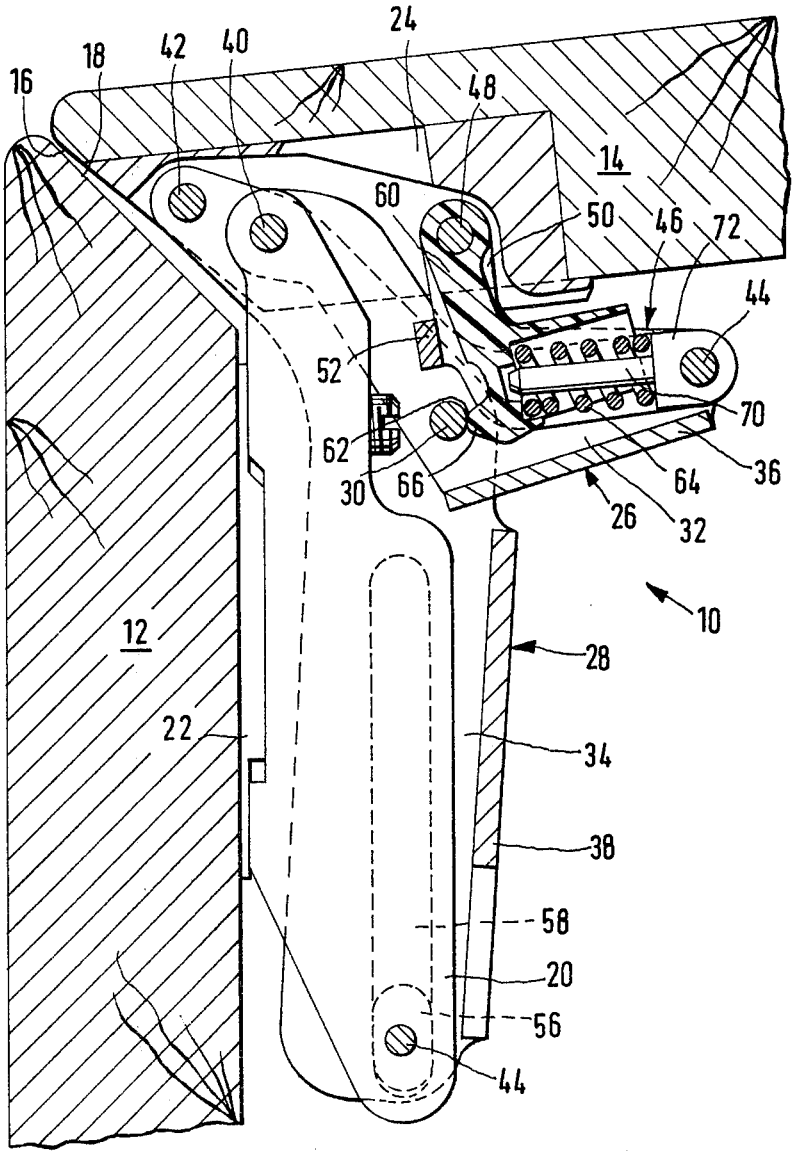
FIG. 2 shows the hinge of FIG. 1 with the over-center mechanism in the dead center position.
Figure 3:
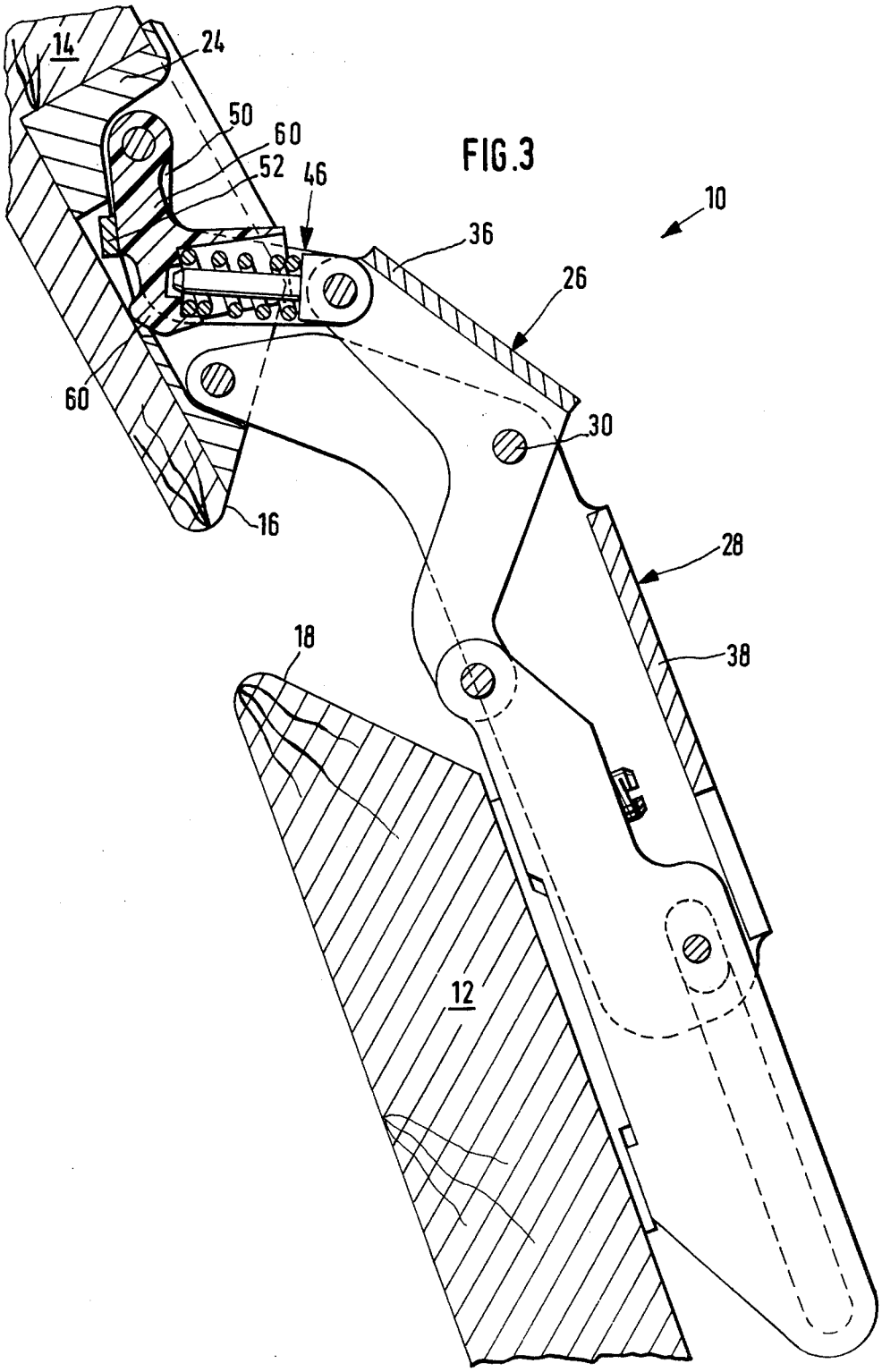
FIG. 3 shows the hinge of FIGS. 1 and 2 in the open position.

The crosslink over-center hinge 10 of the invention, represented in FIGS. 1 to 3, serves to mount a door 14 on the side wall 12 of a cabinet carcass, and in the present case it is a door whose edge 16 is beveled at an angle of about 45° from front to back. The front edge 18 of the supporting wall 12 is correspondingly beveled at 45°, so that the door 14, when in the closed position, will be within the space provided by the beveling of the front edge 18 of the supporting wall 12, in the manner represented in FIG. 1. The door 14 can thus be considered as a "recessed door with mitered recess" the mitered recess being constituted by the complementary 45° angle bevels on the edges 16 of door 14 and 18 of wall 12 of the cabinet carcass. It is apparent that with such a mitered-recess door, a hinge is required having an action which has, especially at the beginning of the opening movement, a relatively great component of movement out of the interior of the cabinet, this component being simultaneously combined with a certain component which shifts the door away from the inner side of the supporting wall at right angles thereto. Such an action cannot be achieved with the known four-joint hinges, especially when the door 14 is relatively thick. The hinge 10 of the invention is therefore in the form of a crosslink hinge which permits the necessary motion.

The supporting wall-related member 20 of the hinge 10 is adjustably fastened in the conventional manner to the supporting wall 12 by means of a mounting plate. The door-related part is in the form of a known mortise cup 24 from which in the present case, however, the part of the wall that would project beyond the chamfered edge 18 is cut away. The mortise cup 24 is, as a rule, made of plastic by the injection molding process or of metal by the die casting process.

The crosslink is formed of two arms 26 and 28 which are joined together in their middle area by a pivot pin 30 so as to pivot in a scissor-like manner. The arms 26 and 28 are formed each by two side plates 32 and 34 which are joined together to form a single component by web portions 36 and 38, respectively.

The distance between the side plates 32 of the arm 26 is such that they can pass between the insides of the side plates 34 of the arm 28. The arm 26 is journaled by means of a pivot pin 40 on the supporting wall member 20 and the arm 28 is journaled by means of a pivot pin 42 on the mounting cup 24.

At the other end of the arm 26, an L-shaped link 46 is mounted on a pivot pin 44 and its other end is journaled on a pivot pin 48 in the cup 24. The link 46 is composed—in a manner similar to linkage arms 26 and 28—of two side plates 50 which are parallel to one another at a distance sufficient to permit them to enter between the inside surfaces of side plates 32 of the linkage arm 26. A web 52 joins the side plates 50 to the integral link 46.

The second end of arm 28, however, is frictionally guided on the supporting wall member 20. This is accomplished by means of short slide blocks 56 which extend inwardly from the side plates 34 of arm 28 and are rotatably mounted on pins 54, and which are engaged in elongated external grooves 58 in the supporting wall member 20. Instead of the sliding guide means illustrated and described, the cabinet-internal end of the linkage arm can alternatively be coupled indirectly to the supporting wall member 20 by means of a link.

The over-center mechanism of the hinge 10 is formed by a lever-like plastic over-center element 60 journaled on the mortise cup pivot pin 48 between the side plates 50 of link 46, which has a cam 66 having two flanks 62 and 68. Flank 62 serves as a catch for engaging the pin 30 when the hinge is in the closed position, and it is held in engagement therewith by the force of a compressively biased coil spring 64 one end of which acts on the free end of the over-center element 60 while the other end acts on the free end of the link 46. From the drawings it is apparent that the web 52 uniting the side plates 50 of the link 46 serves simultaneously as a stop limiting the rocking movement of the over-center element, so that this element is held by the web 52 in those hinge positions in which it is not resting against the linkage arm pivot pin 30.

As the hinge is closing, the pivot pin 30 will first run against the other flank 68 of cam 66, thereby rocking the over-center element against the action of the spring 64 until the dead-center position represented in FIG. 2 is reached. As long as the pivot pin 30 is engaged with flank 68, the force of spring 64 will act to open the hinge, but after the dead-center position is passed, it will exercise on the flank 62 a force tending to close the hinge. If the over-center element 60 is made of a plastic having good wear resistance and low friction, the cam 66 can slide directly on the pivot pin 30 in the manner illustrated. Alternatively, a thin bearing sleeve, which is not shown, can be journaled on the pivot shaft 30 such that it will roll on the cam surface thereby preventing wear due to friction.

The spring 64 is held between the side plates 50 of the link 46 by a pin-like element 70 passing through its coils, and having a head 72 against which the spring thrusts and which is held by the pivot pin 44 connecting the link 46 to the arm 26. The pin-like element 70 and its head 72 are preferably made in one piece of plastic.

Although the crosslink over-center hinge 10 in accordance with the invention has been described for a particular application in which a recessed door with mitered recess is to be mounted on a cabinet carcass and the opening angle of the door amounts to less than 180°, it is apparent that the hinge of the invention can also be used as a 180° crosslink hinge for an overlapping door. It is essential only that the link 46 be so formed that its middle portion is in the vicinity of the linkage arm pivot shaft 30 when the hinge is in the closed position, so that the over-center element 60 can engage the pivot pin 30 with its cam flank 62. The position of the dead center point of the over-center mechanism, as well as the over-center characteristic and the strength of the closing force can be influenced by changing the shape of the cam flank 62 or of the shape of the cam flank 68, and by changing the tension of the spring 64.

I claim:

1. A crosslink over-center hinge movable from an open to a closed position and vice versa and having a supporting wall member and a door member, a crosslink mechanism joining said two members together and comprising first and second linkage arms, pivot shaft means coupling said linkage arms pivotingly together in their middle area, one end of one of said linkage arms being journaled on the supporting wall member and one end of the other linkage arm being journaled on the door member, the other ends of said linkage arms being respectively coupled to the door member and the supporting wall member for guidance on a curve in space, an over-center mechanism having a closing spring, said mechanism resiliently urging the hinge to the hinge end position at least in the vicinity of the closed position of said hinge, a link coupled to the door by a pivot shaft means and connecting the door member to said first linkage arm and being so formed that its middle area is situated, when the hinge is in the closed position, in the vicinity of said pivot shaft means pivotingly coupling said linkage arms; said over-center mechanism being disposed at said link and having an elongated over-center element pivotingly mounted on said pivot shaft means of said link in said door member, said element having a locking surface engaging said pivot shaft means in range of the hinge-closed position, said over-center element being biased by said closing spring supported in the area of the other end of said link towards an engagement of said locking surface with said pivot shaft means.

2. A hinge according to claim 1, wherein said over-center mechanism is received in said link, said link having two side plates disposed at a parallel distance from one another, said over-center element and said closing spring being disposed between said side plates.

3. A hinge according to claim 2, comprising a web joining said side plates of said link, said web serving as a stop for limiting the rocking movement of said over-center element.

4. A hinge according to any one of claims 1 to 3, wherein said closing spring is a coil spring under compressive bias, said coil spring having an end remote from said over-center element, a pivot pin joining said link to said first linkage arm, said end resting against said pivot pin.

5. A hinge according to claim 4, comprising a pin-like element holding said coil spring and passing centrally therethrough, said pin-like element having an end remote from said over-center element, said end of said pin-like element being enlarged to form a journal head supporting said coil spring, a pivot pin connecting said link to said first linkage arm passing through said head.

6. A hinge according to claim 5, wherein said side plates of said link substantially completely conceal laterally the over-center element, said closing spring and said element holding said spring.

7. A hinge according to any one of claims 1 to 3, wherein said over-center element has adjacent its end lying in front of said locking surface an ascending cam section which said linkage arm pivot shaft means engages and slides along during the closing movement of the hinge before reaching said closed position, while, as a result of the bias exercised on said over-center element, a force working in the hinge opening direction first acts on said linkage arm pivot shaft means until a dead-center position is reached in which said cam section passes over into said locking surface and said locking surface of said over-center element is forced over the linkage arm pivot shaft means by the exertion of a force acting in the hinge closing direction.

8. A hinge according to claim 7, comprising a loose, rotatable bearing sleeve on said linkage arm pivot shaft means cooperating with said cam section.

9. A hinge according to any one of claims 1 to 3, comprising a loose, rotatable bearing sleeve on said linkage arm pivot shaft means cooperating with said locking surface.

10. A hinge according to claim 6, wherein said over-center element and said elements holding said closing spring in said link are made of plastic.

11. A hinge according to claim 1, wherein said over-center mechanism is received in said link.

* * * * *